US005836164A

United States Patent [19]

Tsukahara et al.

[11] Patent Number: 5,836,164

[45] Date of Patent: Nov. 17, 1998

[54] GAS TURBINE COMBUSTOR

[75] Inventors: Satoshi Tsukahara, Hitachi; Shohei Yoshida, Hitachioota; Masahiko Yamagishi, Hitachi; Kazumi Iwai, Mito; Hiromi Koizumi, Hitachi; Yoichi Yoshinaga, Mito, all of Japan

[73] Assignee: Hitachi, Ltd., Tokyo, Japan

[21] Appl. No.: 593,087

[22] Filed: Jan. 29, 1996

[30] Foreign Application Priority Data

Jan. 30, 1995 [JP] Japan ..... 7-012304

[51] Int. Cl.[6] ..... F02C 1/00

[52] U.S. Cl. ..... 60/733; 60/737; 60/738; 60/747; 60/748

[58] Field of Search ..... 60/39.37, 732, 60/733, 737, 738, 746, 747, 748, 742, 760

[56] References Cited

U.S. PATENT DOCUMENTS

| | | | |
|---|---|---|---|
| 4,982,570 | 1/1991 | Waslo et al. | 60/733 |
| 5,069,029 | 12/1991 | Kuroda et al. | 60/733 |
| 5,235,814 | 8/1993 | Leonard | 60/738 |

FOREIGN PATENT DOCUMENTS

| | | |
|---|---|---|
| 2-100060 | 8/1990 | Japan . |
| 4-124520 | 4/1992 | Japan . |
| 5-196232 | 8/1993 | Japan . |
| 5-215338 | 8/1993 | Japan . |
| 6-137559 | 5/1994 | Japan . |

*Primary Examiner*—Charles G. Freay

*Attorney, Agent, or Firm*—Fay, Sharpe, Beall, Fagan, Minnich & McKee

[57] ABSTRACT

A gas turbine combustor includes a diffusion combustor arranged at an axis portion of a combustion chamber for effecting diffusion combustion, a plurality of first premixing combustors arranged at an outer periphery of the diffusion combustor for effecting premixed combustion, each of the plurality of first premixing combustors being formed so that a mixture outlet end thereof projects more downstream than a fuel outlet end of the diffusion combustor, and a plurality of second premixing combustors each formed so that a mixture outlet thereof projects more downstream than the mixture outlet end of the first combustor, wherein the first premixing combustors and the second premixing combustors are arranged alternately at the outer periphery of the diffusion combustor, and wherein a swirler is provided on the first premixing combustor in the vicinity of the mixture outlet end thereof for swirling mixture.

12 Claims, 11 Drawing Sheets

GAS TURBINE COMBUSTOR

BACKGROUND OF THE INVENTION

1. Field of the Invention

The present invention relates to a gas turbine combustor and, more particularly, to a gas turbine combustor which is suitable for reduction of NOx by effecting lean premixed combustion.

2. Description of the Related Art

An example of a gas turbine combustor in which lean premixed combustion is effected mainly is disclosed in JU A (Japanese Utility Model Laid-open) 2-100060 (1990). A diffusion combustor arranged at an axis of an inner combustion liner works for raising combustion stability. Further, a lean fuel mixture is supplied while being swirled from each premixing chamber of a multi-annular premixing combustor arranged at the outside of the diffusion combustor and burnt, being supported by diffusion combustion.

SUMMARY OF THE INVENTION

An object of the invention is to provide a gas turbine combustor which has a high combustion efficiency and a high ratio of premixed combustion (by which NOx production is less) to diffusion combustion (by which NOx production is more), even under the condition of partial combustion, and at the same time effects stable combustion even under the condition of low fuel concentration of the mixture. Further, the object is to provide a gas turbine combustor which is capable of low NOx combustion in a wide range of load.

A first feature of a gas turbine combustor according to the present invention to carry out the above object resides in that a diffusion combustor arranged in an axis portion of a combustion chamber to inject fuel and effect diffusion combustion, a plurality of first premixing combustors at the outer periphery side of the diffusion combustor to inject a mixture of fuel and air and effect premixed combustion and having their mixture outlet ends projected more downstream than a fuel outlet end of the diffusion combustion, and a plurality of second premixing combustors having their mixture outlet ends projected more downstream than the mixture outlet ends of the first premixing combustors, are provided, and the above-mentioned first and second premixing combustors are alternately arranged at the outside of the diffusion combustor.

Concretely, the feature resides in that a diffusion combustor arranged in an axis portion of a combustion chamber to inject fuel and effect diffusion combustion, a plurality of first premixing combustors at the outer periphery side of the diffusion combustor to inject the mixture of fuel and air and effect premixed combustion and having their mixture outlet ends projected more downstream than a fuel outlet end of the diffusion combustion, and a plurality of second premixing combustors having their mixture outlet ends projected more downstream than the mixture outlet ends of the first premixing combustors, are provided, the above-mentioned first and second premixing combustors are alternately arranged at the outside of the diffusion combustor, and a swirler for imparting swirling motion to the mixture is provided in the vicinity of the mixture outlet of the above-mentioned first premixing combustor.

Further, a second feature of the present invention resides in that swirlers for imparting swirling motion to a mixture are provided in the vicinity of the mixture outlets of the first and second premixing combustors, respectively, and a swirling momentum imparted by the swirler of the first premixing combustor is larger than that imparted by the swirler of the second premixing combustor.

A third feature of the present invention resides in that in a construction formed so as to cool a combustor by flowing air between the outer combustion liner and the inner combustion liner, the mixture outlet end of the premixing combustor is formed so that a direction of the mixture jetted from the premixing combustor is directed toward the axis of the inner combustion liner.

Further, a fourth feature of the present invention resides in that a flow passage for air supply is provided at an outer periphery portion of the above-mentioned premixing combustor. It is preferable to provide the flow passage at least for the second premixing combustor. In an outer periphery portion of the second premixing combustor, an aspect can be taken in which air is caused to flow to the liner end along the liner direction.

A fifth feature of the present invention resides in a diffusion combustor comprising a first fuel nozzle being tubular and arranged at an axis portion and having an inlet end and a discharge end, a first air supply pipe which is coaxial with the first fuel nozzle, positioned at the outer periphery of the first fuel nozzle, having a first swirler at the inlet end, and having a discharge end thereof in the vicinity of the discharge end of the first fuel nozzle, a second tubular air supply pipe being coaxial with the first fuel nozzle, positioned at the outer periphery of the first air supply tube, and having a second annular swirler in the vicinity of the discharge end of the first air supply pipe for swirling in the same direction as that of the first swirler, a combustion chamber disposed downstream of the discharge end of the second air supply pipe, a plurality of first fuel jet ports at the discharge end of the first fuel nozzle, and a plurality of second fuel jet ports positioned between the first swirler of the first air supply pipe and the discharge end, and at the side face of the first fuel nozzle.

The above-mentioned plurality of first fuel jet ports are directed radially of an axis of the first fuel nozzle to a downstream side, for instance. The above-mentioned second fuel jet ports is formed so as to direct from a side face of the first fuel nozzle to the inner wall of the first air supply pipe and incline to the discharge side.

Further, a sixth feature of the present invention resides in that in the above-mentioned diffusion combustor, the inlet ends of the first air supply pipe and the second air supply pipe are branched from a common air pipe line, a second fuel nozzle having at least one jet port for jetting fuel to be mixed with air supplied to the first air supply pipe and the second air supply pipe is added at an upstream side of the branch portion, whereby the diffusion combustor is changed into a diffusion-premixing combustor controlling independently fuel to be supplied to the first fuel nozzle and the second fuel nozzle.

Further, a seventh feature of the present invention resides in a gas turbine combustor controlling the number of diffusion-premixing combustors operated according to load increasing by arranging the plurality of diffusion-premixing combustors defined in the sixth feature in parallel, forming one combustion chamber downstream of the discharge end of the second air supply pipe. The number of the above-mentioned combustors to be operated can be increased as load increases.

Further, an eighth feature resides in a construction that means for supplying fuel is provided on means for supplying air in the vicinity of the fuel outlet of the diffusion combustor, and mixture of fuel and air is supplied from each means for supplying air to around the fuel outlet of the diffusion combustor. Namely, the construction is for forming a flame around a central portion of the combustor by mixing fuel for the diffusion combustor with the above-mentioned mixture. Premixed combustion can be maintained in a wide load range until time of a low load by supplying mixture from not only means for supplying air on the periphery side but from each means for supplying air.

Further, the gas turbine construction of the first feature of the present invention can be provided with means for supplying mixture defined in the vicinity of the fuel outlet of the diffusion combustor including the fifth feature of the present invention.

Further, a ninth feature of the present invention resides in that means for supplying mixture in the vicinity of the fuel outlet of the diffusion combustor including the fifth feature of the present invention, that is, a first swirler for imparting swirling motion to the mixture and a second swirler positioned at the outer periphery side of the first swirler, are provided at the mixture outlet end of the premixed gas injection nozzle, and the first and second swirlers are constructed so that a flow rate of mixture jetted from the second swirler is larger than that jetted from the first swirler.

The construction including the ninth feature of the present invention can be adapted for any construction of the first to the fourth features.

Further, a tenth feature of the present invention resides in a combustor, having an outer combustion liner and an inner combustion liner provided inside the outer combustion liner forming a combustion chamber, which combustor is constructed so as to be cooled by air flowing between the outer and inner combustion liners, and comprising a plurality of first premixing combustors arranged at an outer periphery side of a diffusion combustor for effecting premixed combustion, and formed so that a mixture outlet of each of them projects more downstream than the fuel outlet end of the above-mentioned diffusion combustor, a plurality of second premixing combustors formed so that their mixture outlet ends project more downstream than the mixture outlet ends of the first premixing combustors, a mixture jet nozzle for supplying a mixture of air and fuel into the combustion chamber in the vicinity of the fuel outlet of the diffusion combustor provided between the above-mentioned diffusion combustor and the above-mentioned first and second premixing combustors, and said first and second premixing combustors being alternately arranged in a peripheral direction at the outer periphery side of the above-mentioned diffusion combustor, a swirler provided in the vicinity of the mixture outlets of the first premixing combustors for imparting swirling motion to the mixture, an air flow hole formed on the above-mentioned inner combustion liner or a transition piece for introducing air flowing between the outer and inner combustion liners into the above-mentioned combustion chamber, and an air flow control valve for controlling a flow rate of air flowing through the air flow hole.

Further, an eleventh feature of the present invention resides in a gas turbine combustor comprising a diffusion combustor provided at an axis portion of the gas turbine combustor for injecting fuel and effecting diffusion combustion, a plurality of first premixing combustors arranged at the outer periphery of the diffusion combustor for injecting a mixture of air and fuel and effecting premixed combustion, a plurality of second premixing combustors formed so that their mixture outlets project more downstream than the mixture outlets of the first premixing combustors, a mixture jet nozzle for supplying the mixture of air and fuel into the combustion chamber in the vicinity of the fuel outlet of the diffusion combustor provided between the above-mentioned diffusion combustor and the above-mentioned first and second premixing combustors, the above-mentioned first and second premixing combustors being alternately arranged in a peripheral direction at the outer periphery side of the above-mentioned diffusion combustor, and a swirler provided in the vicinity of the mixture outlets of the first premixing combustors for imparting swirling motion to the mixture, such that fuel is injected from the mixture jet nozzle in turn into the first premixing combustor and the second premixing combustor in the mentioned order so as to increase a flow rate of the mixture.

According to the first feature of the present invention, the first premixing combustor is formed so that the mixture outlet thereof projects more downstream than the fuel outlet end of the diffusion combustor, the second premixing combustor is formed so that the mixture outlet end thereof projects more downstream than the mixture outlet end of the first premixing combustor, and the first premixing combustor and the second premixing combustor are alternately arranged in the circumferential direction at the outer periphery of the diffusion combustor, so that a diffusion combustion flame from the diffusion combustor ignites the first premixing combustor and the second premixing combustor in turn in the mentioned order, whereby ignition performance (ignitability) of the premixing combustor is improved, after the ignition interference between the diffusion combustion flame and the premixed combustion flame can be suppressed, so that the diffusion combustion flame can maintain stable combustion, and the premixed combustion flame becomes less influenced by high temperature flame, so that the characteristic of the premixing combustor that lean combustion is effected to suppress NOx production can be utilized.

Further, by surely providing the first premixing combustor with a flame stabilizing function, a flow rate of fuel for the diffusion combustion can be reduced greatly, a ratio of the diffusion combustion to the premixed combustion can be suppressed to be low. Therefore, NOx can be reduced remarkably. Further, premixed combustion can be maintained in a wide range of gas turbine load from a low load region to a high load region. At time of premixed combustion operation, combustion can be effected by changing the ratio of premixed combustion to any value by setting and respond to a rapid change in operation conditions, etc.

Further, at time of diffusion combustion, combustion is sufficiently finished before the combustion flame is cooled by inflow air from the premixing combustor, so that stable combustion is effected in a wide range of operation mode such as only diffusion combustion, diffusion combustion and first stage premixed combustion, and diffusion combustion and first stage and second stage premixed combustion.

Further, according to the above-mentioned second feature of the present invention, stability of premixed combustion flame can be maintained effectively.

Further, it can be suppressed that the outer periphery portion of the premixing combustor is overheated by diffusion combustion flame or other premixed combustion flame.

Further, according to the above-mentioned third feature of the present invention, the mixture outlet end of the premixing combustor is formed so that mixture jetted from the premixing combustor flows to the axis of the inner combustion liner, whereby premixed combustion flame is not cooled by cooling air flowing around the side face of the inner combustion liner, so that the combustion temperature of the premixed combustion flame can be suppressed to be lowered and emission of unburnt products can be suppressed.

Further, according to the above-mentioned fourth feature of the present invention, an input heat amount from the diffusion combustion flame and other premixed combustion flames to the side face of the premixing combustor can be reduced. For example, when this is applied to the second premixing combustor, a heat input amount to the side face of the second premixing combustor by diffusion combustion flame and first stage premixed combustion flame can be reduced, so that it can be attributed to a lowering of the metal temperature in the gas turbine combustor. Further, it is preferable to jet air so that air flows along the outer periphery of the second premixing combustor.

According to the fifth feature of the present invention, when a flow rate of fuel becomes small, diffusion combustion is effected while being mixed with only air supplied from the first air supply pipe. However, the combustion flame of fuel jetted from the first fuel port of the first fuel nozzle is stabilized by secondary air flow formed by the discharge end of the first fuel nozzle, fuel jetted from the second fuel jet port provided on the side face of the first fuel nozzle flows along the outer wall surface of the first fuel nozzle, and flows into a stabilization zone of fuel jetted from the first fuel jet port under the condition that the fuel is partially mixed with air, so that the concentration of the fuel in the stabilization zone becomes close to a stoichiometric fuel/air ratio, which is the fuel concentration at which fuel is easiest to burn, and stability of the diffusion flame is improved.

Further, according to the sixth feature of the present invention, since mixture is supplied from the above-mentioned first air supply pipe and the above-mentioned second air supply pipe, the diffusion flame in the vicinity of the axis of the combustion chamber becomes high in combustion stability, and since a heat amount necessary for combustion stability can be supplied at the surface contacting with mixture flowing in from the above-mentioned second swirler, stable combustion can be effected in all the diffusion and premixing combustors. Further, in this construction, diffusion fuel and premixing fuel can be controlled independently from each other. Therefore, diffusion fuel is reduced to be small and diffusion combustion is effected by mixture supplied from the first air supply pipe at the outer periphery of the diffusion fuel, and almost all of the mixture is subjected to the premixed combustion, whereby combustion of high stability can be effected, with small NOx production.

Further, according to the seventh feature of the present invention, the diffusion-premixing combustor, which has reduced NOx production and high combustion stability, controls the number of combustors to be operated according to a gas turbine load, so that an operation in which NOx production is small can be achieved in a wide range of gas turbine load. At time of starting, the starting can be done in turn from any combustor, and it is possible to accord with gas turbine combustor characteristics.

Further, according to the above-mentioned eighth feature of the present invention, since mixture is supplied in the vicinity of the fuel outlet of the diffusion combustor, diffusion fuel is mixed with the mixture an burnt. Therefore, stability of the diffusion combustion flame is improved remarkably. That is, the present invention constructs the diffusion combustor so that the diffusion combustion flame is formed at a central portion of the combustion chamber by the diffusion fuel and the mixture, instead of a conventional diffusion combustor in which diffusion combustion is effected by only diffusion fuel. More stable combustion can be effected, compared with a case where mixture of air and fuel is supplied from a part of the air supply means of the periphery of the diffusion combustor, a load range in which premixed combustion can be effected can be widened, and it can accord with low NOx restrictions which have been severe in recent years.

Further, according to the above-mentioned ninth feature of the present invention, the first swirler is provided in the vicinity of the fuel outlet of the diffusion combustor for imparting swirling motion to the mixture, the second swirler is provided so as to be positioned at the outer periphery of the first swirler, and the above-mentioned first and second swirlers are constructed so that swirling directions of mixture jetted from the first swirler and the second swirler are the same as each other and a flow rate of mixture jetted from the second swirler becomes larger than that from the first swirler, so that diffusion fuel jetted from the diffusion nozzle provided at the axis of the combustion chamber is mixed with mixture flowed from the first swirler to form mixture which is easier to be burnt, and it is possible to stabilize the diffusion combustion flame. At this time, when there is too much mixture from the first swirler, an effect of raising the combustion temperature during combustion by only mixture, even if diffusion fuel is injected, becomes small, an effect of stabilizing the combustion flame is lowered. Therefore, the combustor is constructed so that mixture beyond a necessary amount is flowed into the second swirler at the outer periphery side of the first swirler. That is, by constructing so that the swirling directions of mixture from the first and second swirlers are the same as each other and a flow rate of mixture jetted from the second swirler becomes larger than that from the first swirler, the mixture of an amount exceeding the necessary amount for stabilizing the above-mentioned diffusion combustion flame is supplied to about the central portion of the diffusion combustion flame through the second swirler, and reacts with the diffusion combustion flame without detracting from the stability of the diffusion combustion flame. Further, by using the mixture of fuel and air as air for diffusion combustion, stable combustion can be effected even if the conditions that fuel jetted from the diffusion nozzle provided at the axis is small, and low NOx combustion can be achieved.

Further, according to the above-mentioned tenth feature of the present invention, since the air flow hole is formed in the tail tubular liner or the inner combustion liner, and a flow rate of air flowing into the combustion chamber through the air flow hole is controlled, a flow rate of air supplied to the combustion zone can be reduced, the concentration of fuel air mixture can be kept constant and combustion of high efficiency and low NOx becomes possible.

Further, according to the above-mentioned eleventh feature of the present invention, since a fuel supply rate can be increased without changing largely a mixing ratio of each of the mixture jet nozzle, the first premixing combustor, and the second premixing combustor, stability of the premixed combustion flame can be raised further.

In the JU A 2-100060, for example, since under the condition that combustion is effected only at the central portion of the combustor, the flame is cooled by air from the outer periphery, in some cases a part of fuel is exhausted without being burnt and a lot of noxious carbon monoxide may be exhausted. In the present invention, combustion efficiency is high under the condition that combustion is effected in part, and it is possible to reduce a ratio of diffusion combustion in which NOx is produced more, increase a ratio of premixed combustion in which NOx is produced less, and effect low NOx combustion in a wide range of load.

DETAILED DESCRIPTION OF THE PREFERRED EMBODIMENTS

Figure 1:
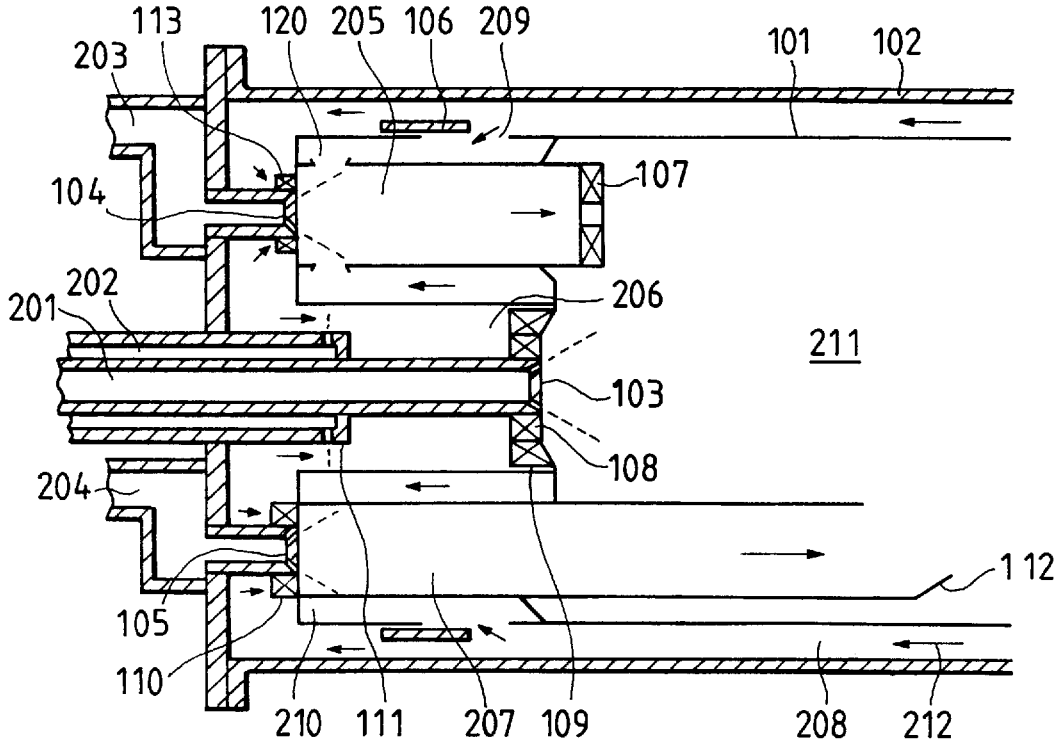
FIG. 1 is a vertical sectional view of a gas turbine combustor of an embodiment of the present invention.
Figure 2:
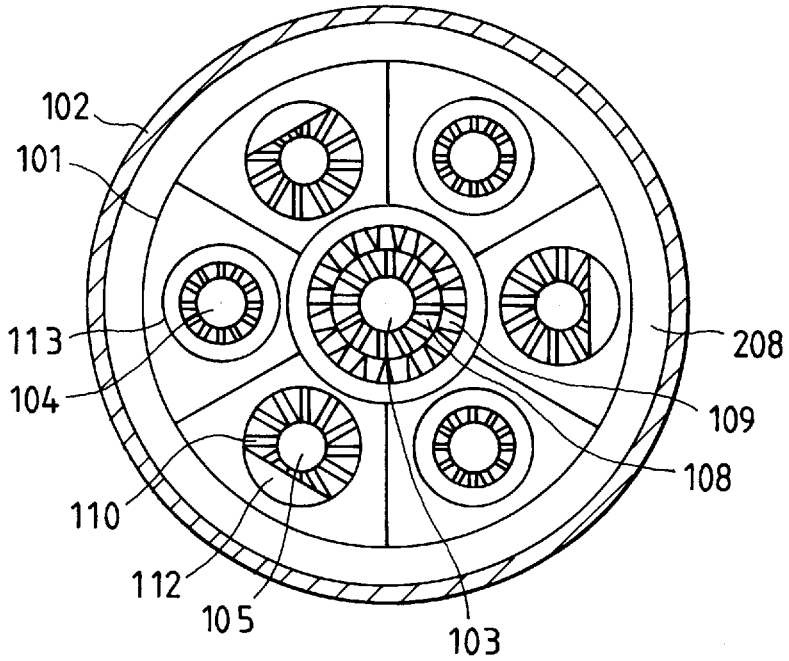
FIG. 2 is a lateral sectional view of a gas turbine combustor of an embodiment of the present invention.

An embodiment of a gas turbine combustor according to the present invention is explained hereunder, referring to FIGS. 1 and 2.

FIG. 1 is a vertical sectional view of a gas turbine combustor of the present embodiment. The combustor has an outer portion formed by a cylindrical outer combustion liner 102 which is a pressure housing containing the whole of the combustor, and an inner combustion liner 101 inside the outer combustion liner 102 and forming a combustion chamber 211. In the combustion chamber 211 formed by the inner combustion liner 101, a first fuel nozzle 103 which is a diffusion fuel nozzle for jetting or injecting diffusion fuel is provided at the center of an end portion of the combustion chamber 211.

The constructions of features of the present embodiment in the combustor having the above construction is explained hereunder.

At the outer periphery of the first fuel nozzle 103, an annular first swirler 108 is provided for imparting swirling motion or swirling to air supplied in the vicinity of the fuel outlet of the first fuel nozzle 103 and a second swirler 109 at the outer periphery of the first swirler 108, and a premixed fuel (mixture) injection nozzle comprising a second fuel nozzle 111 for mixing fuel with air from the first and second swirlers 108 and 109 and a first premixing chamber 206 between the second fuel injection nozzle 111 and the first and second swirlers 108 and 109. Further, the first and second swirlers 108 and 109 are made so that the swirling direction of mixture from the first swirler 108 is the same as that from the second swirler 109, and a flow rate of mixture from the second swirler is lager than that from the first swirler 108. For example, it can be achieved by making an area of the second swirler 109 through which fluid passes larger than that of the first swirler 108.

The swirled mixture from the first swirler 108 is mixed with fuel injected from the first fuel injection nozzle 103 to form the diffusion flame. An amount of supply of this mixture is sufficient to be an amount at which the diffusion flame is stabilized. When a lot of lean mixture is supplied to a root portion of the flame which combustion reaction of fuel and air does not produce, the diffusion flame becomes unstable and an increase in unburnt fuel and a decrease in combustion efficiency due to lowering of combustion gas temperature may be brought about. Therefore, mixture of an amount exceeding an amount necessary to stabilize diffusion flame is flowed out from the swirler 109. The mixture flowed out of the second swirler 109 is supplied into a central portion or downstream portion of the flame of which combustion reaction of fuel and air proceeds to some extent or has almost finished. In order to supply the mixture of an amount exceeding an necessary amount into the central portion or the downstream portion of the flame, the swirlers 108 and 109 can be formed so that the mixture outlet end of the second swirler 109 projects more downstream than that of the first swirler 108.

Further, the above-mentioned mixture injection nozzle is provided with, at its outer periphery, a first premixing combustor comprising a second premixing chamber 205, a third fuel nozzle 104 at the center of an end of the second premixing chamber 205, a swirler 113 for air supply at the outer periphery of the nozzle 104, and air holes 120; and a second premixing combustor comprising a third premixing chamber 207 formed so that its mixture outlet end projects more downstream than the mixture outlet end of the first premixing combustor, a fourth fuel nozzle 105 at the center of an end of the third premixing chamber 207, and a swirler 110 for air supply at its outer periphery. Further, the first premixing combustor is provided with, at the mixture outlet end portion, a swirler 107 for imparting swirling to the mixture to promote mixing of fuel and air and stabilize the premixed combustion flame.

Further, in case where ignition for premixed combustion is effected from diffusion combustion, also, transition of firing is easy.

The first premixing combustor is provided with an air rectifying chamber 210 for supplying air to the second premixing chamber 205, an air inlet 209 thereof, and an air flow control valve 106 for controlling the opening of the air inlet 209. The second premixing combustor is provided with a swirler 110 for air supply at its outer periphery, and a deflection plate 112 for determining an outlet flow direction of mixture from the third premixing chamber 207. The deflection plate 112 causes mixture flow to be directed to the central portion of the combustion chamber 211, and causes flame of the second premixing combustor not to be cooled by air flowing in an annular passage 208 defined by the inner combustion liner 101 and the outer combustion liner 102. In particular, the effect is large when film cooling is effected by flowing air in the inner side face of the inner combustion liner 101. Further, the inner combustion liner 101 does not contact with premixed flame, so that the metal temperature of the inner combustion liner 101 can be lowered.

The above-mentioned first premixing combustors and the above-mentioned second premixing combustors are arranged alternately in a circumferential direction at the outer periphery of the diffusion combustor, as shown in FIG. 2. In this manner, by arranging the first and second premixing combustors, the diffusion flame of the diffusion combustor ignites the first premixing combustors and the second premixing combustors in turn, in the mentioned order, ignitability of the premixing combustors is improved. After the ignition, interference between diffusion flame and premixed combustion flame becomes less, diffusion flame can be stably maintained, the premixed combustion flame becomes less influenced by a diffusion flame of high temperature, so that the characteristic of the premixing combustor that NOx production is suppressed by lean combustion can be utilized. Further, it is unnecessary to arrange the first premixing combustor and the second premixing combustors on the same periphery. It is preferable to arrange the second premixing combustor a little more outside of the circumference on which the first premixing combustor is arranged.

Figure 3:
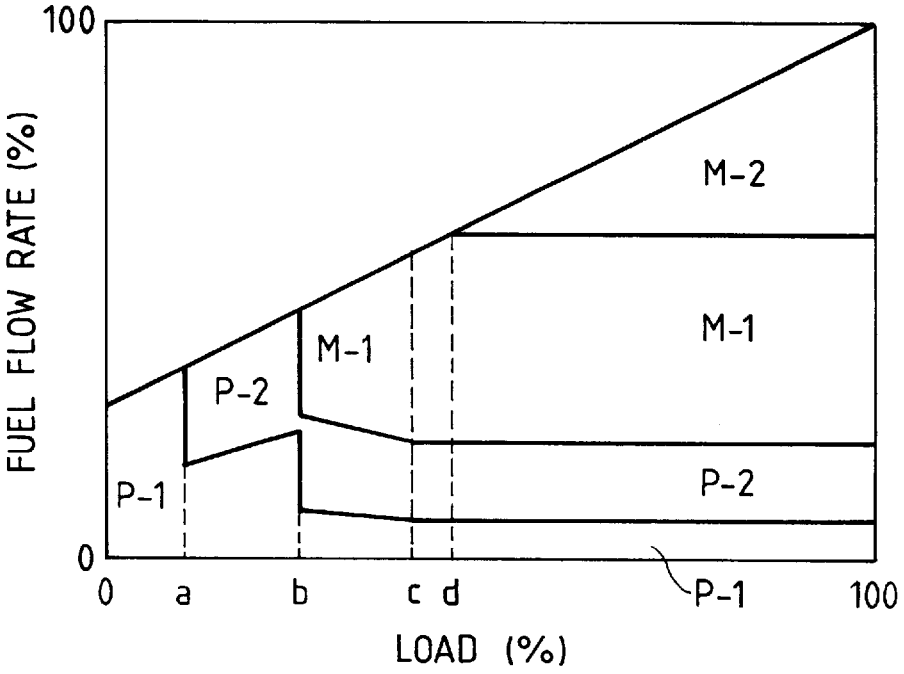
FIG. 3 is a diagram showing an example of a combustion control method in case the gas turbine combustor concerning the present invention is put into practice.
Figure 4:
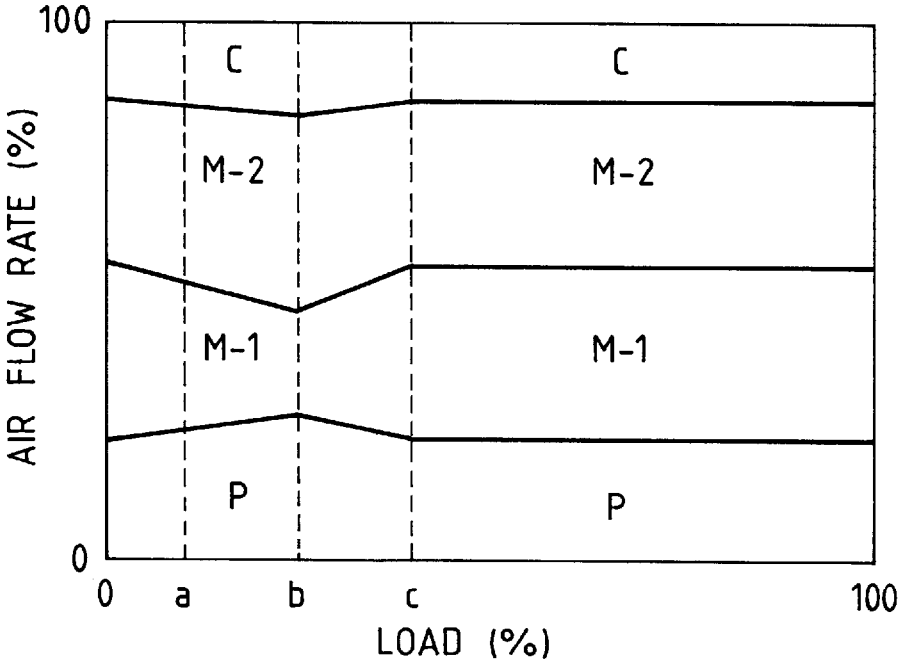
FIG. 4 is a diagram showing an example of an air flow control method in case the gas turbine combustor concerning the present invention is put into practice.

Next, a control method of fuel and air applied to the gas turbine combustor relating to the present invention is explained, referring to FIGS. 3 and 4.

First of all, a fuel and air supply system is explained, referring to FIG. 1.

Combustion air supplied from a compressor (not shown) flows in the annular passage 208 formed by the inner and outer combustion liners 101 and 102 in a direction shown by an arrow 212, branches on its way and then is supplied to the combustion chamber 211 through the first premixing chamber 206, the second premixing chamber 205 and the third premixing chamber 207. Air supplied to the second premixing chamber 205 is controlled as to a flow rate thereof by the air flow control valve 106 provided at the air inlet 209, and then once retarded in the air chamber 210 and flowed into the second premixing chamber 205. On the other hand, fuel for the first fuel nozzle 103 is supplied thereto through a piping 201 and a flow control valve that is not shown, fuel for the second fuel nozzle 111 is supplied thereto through a piping 202 and a flow control valve that is not shown, fuel for the third fuel nozzle 104 is supplied thereto through piping 203 and a flow control valve that is not shown, and fuel for the fourth fuel nozzle 105 is supplied thereto through piping 204 and a flow control valve that is not shown.

Starting ignition at load 0% or less is possible by supplying fuel from the first fuel nozzle 103 of the diffusion combustor, or, it is possible by joint use of fuel supplied from the second fuel nozzle 111 and fuel supplied from the first fuel nozzle 103. Further, when cross-firing to adjacent combustors is necessary at time of starting ignition, a cross-firing tube communicating with adjacent inner combustion liner is provided on the inner combustion liner 101 in the vicinity of the outlet of the second premixing chamber 205, and fuel is supplied to the third fuel nozzle 104 supplying fuel to the second premixing chamber 205 in the vicinity of the cross-firing pipe, thereby to enable cross-firing. Upon finishing of the cross-firing, fuel supply to the third fuel nozzle 104 is stopped, fuel is supplied to the first and third fuel nozzles 103 and 111 to operate until load 0%. Further, even in case where fuel is supplied to only the first fuel nozzle 103, the operation is possible until load 0%. Fuel distribution at load 0% or more is shown in FIG. 3 and the air distribution corresponding thereto is shown in FIG. 4.

In FIG. 3, an abcsissa represents a gas turbine load, and an ordinate a fuel flow rate.

Fuel P-1 is supplied from the first fuel nozzle 103 of the diffusion combustor from load 0% to a %, and burnt in the combustion chamber 211. In a range from load a % to b %, fuel P-2 is added from the second fuel nozzle 111. In a range from load b % to d %, fuel M-1 is added further from the third fuel nozzle 104. In a range of load d % or more, fuel M-2 is added further from the fourth fuel nozzle 105.

In the range from 0% to a %, it also is possible to operate by supplying fuel P-1 from the first fuel nozzle and fuel P-2 from the second fuel nozzle 111.

In the air distribution in FIG. 4, air flowed into the combustion chamber 211 from the first and second swirlers 108, 109 in the vicinity of the axis of the inner combustion liner 101 is represented by P, air flowing into the combustion chamber 211 from the second premixing chamber 205 is represented by M-1, air flowing into the combustion chamber 211 from the third premixing chamber 207 is represented by M-2, and wall surface cooling air of the inner combustion liner 101 is represented by C. In case of load b % or less, combustion is effected only at an axis portion of the inner combustion liner 101. As a total flow rate of fuel P-1 from the first fuel nozzle 103 and fuel P-2 from the second fuel nozzle 111 increases, the air flow control valve 106 is operated to a close direction to decrease air M-1 flowing into the second premixing chamber 205 and increase air P flowing into the first premixing chamber 206, thereby to effect low NOx and high efficiency combustion. At load b %, fuel P-1 from the first fuel nozzle 103 is decreased, and fuel M-1 from the third fuel nozzle 104 is increased, whereby a flow rate of mixture from the second premixing chamber 205 to the combustion chamber 211 is decreased, the concentration of fuel is raised, and the mixture is made easier to be burnt. In the range from load b % to c %, fuel M-1 supplied to the second premixing chamber 205 is increased; however, it is necessary to supply a lean fuel mixture to the combustion chamber 211 to suppress NOx production. Therefore, air M-1 supplied to the second premixing chamber 205 is increased by operating the air flow control valve 106 to an open direction. In a range of load c % or more, the concentration of mixture of fuel and air supplied from the second premixing chamber 205 to the combustion chamber 211 becomes high, and stable combustion is possible without effecting air flow control. However, as the concentration of mixture becomes higher, NOx production becomes greater, so that in the range of load d % or more, fuel M-1 supplied to the second premixing chamber 205 remains constant and fuel M-2 supplied to the third premixing chamber 207 is increased. When fuel M-2 is low, the concentration of mixture supplied from the third premixing chamber 207 to the combustion chamber 211 is low; however, the mixture flows toward the axis of the combustion chamber 211 by the deflection plate 112 provided at the outlet of the third premixing chamber 207, the mixture is burnt, being mixed with combustion gas of mixture supplied from the first premixing chamber 206 and the second premixing chamber 205 to the combustion chamber 211.

By making the fuel piping 203 of the third fuel nozzle 104 into two systems and providing each of them with a fuel control valve, it is possible to maintain a burnable concentration of mixture supplied from a part of the second premixing chamber 205 to the combustion chamber 211 without decreasing air M-1 supplied to the second premixing chamber 205 at load b %, and it is possible to burn the mixture while preventing a large decrease of combustion efficiency. In this case, only air is supplied to the remaining part of the second premixing chamber 205. When the output increases further and load reaches to an intermediate between b % and d %, fuel is supplied to the remaining part of the second premixing chamber 205, whereby high efficiency combustion is possible.

Figure 5:
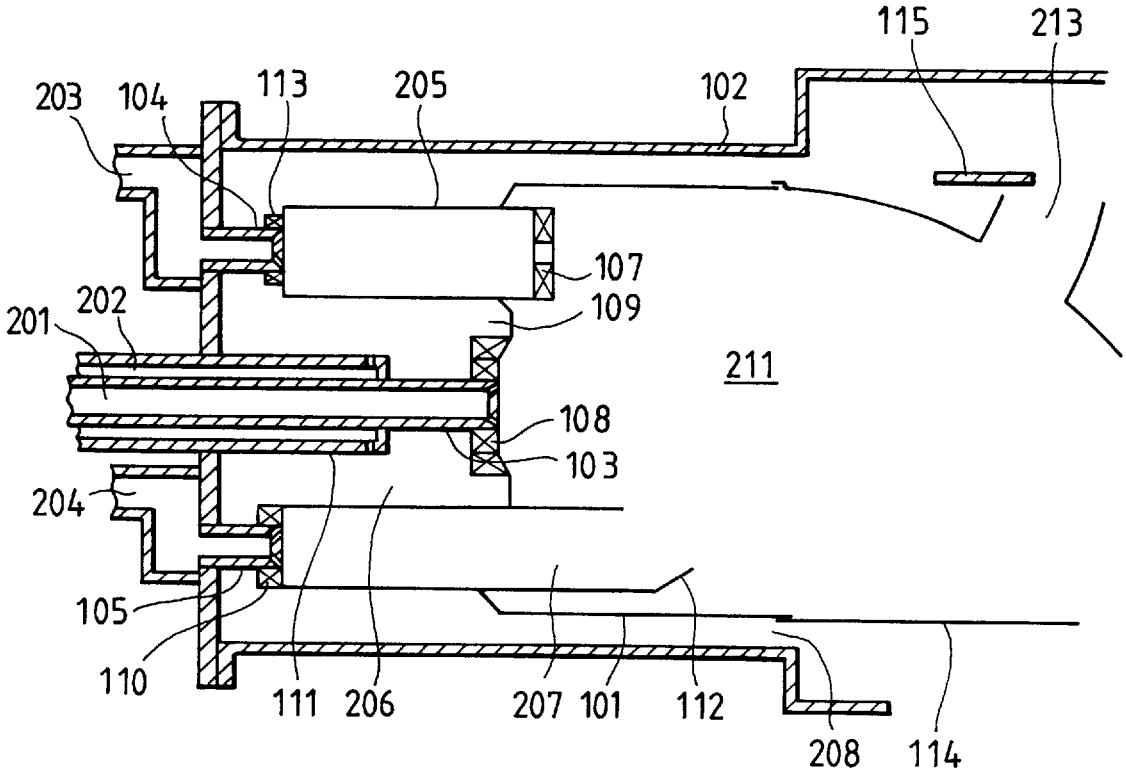
FIG. 5 is a vertical sectional view of a gas turbine combustor of another embodiment of the present invention.

Next, another embodiment of the present invention is explained hereunder, referring to FIG. 5.

A difference from the embodiment of FIG. 1 is an air flow hole 213 through which air flowing in an annular passage 208 formed by the inner combustion liner 101 and the outer combustion liner 102 is directed to the combustion chamber 211, and an air flow control valve 115 for controlling a flow rate of air flowing into the combustion chamber 211 through the air flow hole 213, provided in the side wall of the tail tubular liner 114.

Figure 6:
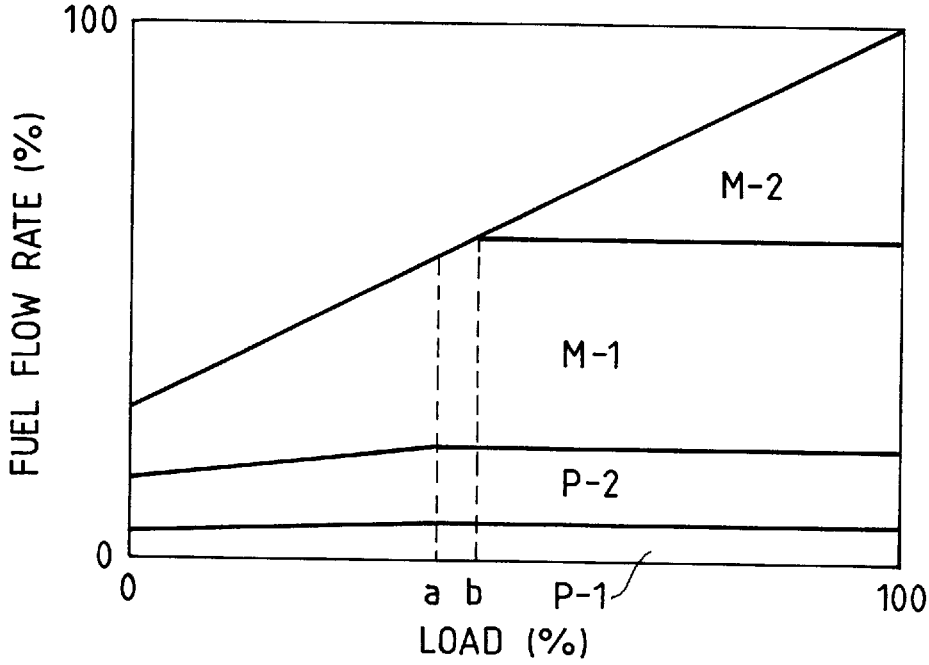
FIG. 6 is a diagram showing an example of a combustion control method in case the gas turbine combustor concerning another embodiment of the present invention is put into practice.

A fuel control method when the above construction in FIG. 5 is employed is explained, referring to FIG. 6.

When the air flow control valve 115 is operated to an open direction, air flowing into the combustion chamber 211 at an upstream side thereof decreases uniformly. Fuel distribution to gas turbine output is shown in FIG. 6. When load is 0% or less, the combustor is operated with only fuel P-1 from the first fuel nozzle 103. In the range of load from 0% to b %, fuel P-2 from the second fuel nozzle 111 and fuel M-1 from the third fuel nozzle 104 are additionally supplied to be burned at the same time. In the range of load b % or more, fuel M-2 from the fourth fuel nozzle 105 is added further.

Figure 7:
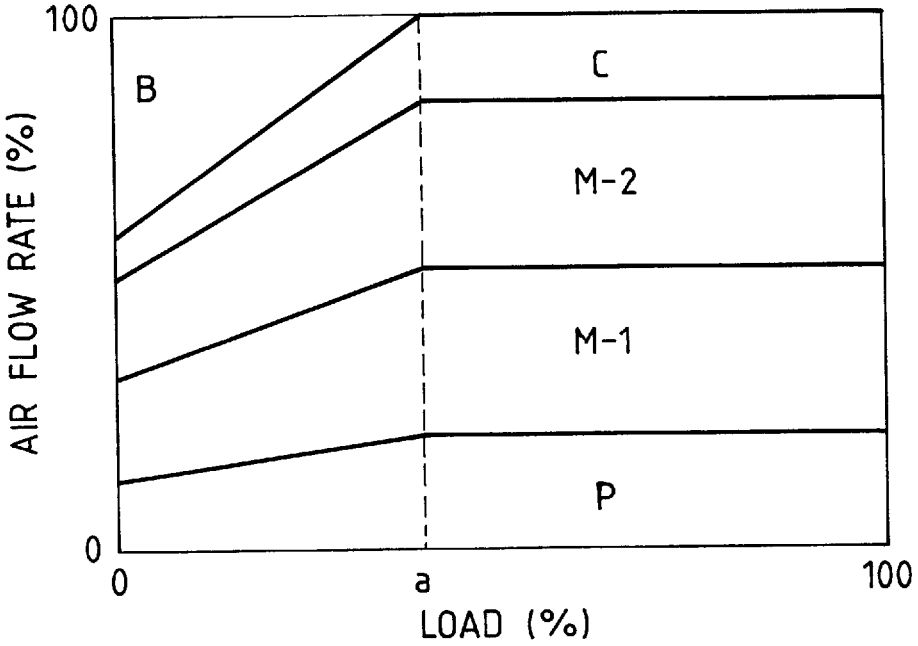
FIG. 7 is a diagram showing an example of an air flow control method in case the gas turbine combustor concerning another embodiment of the present invention is put into practice.

Further, an air control method when the construction shown in FIG. 5 is employed is explained, referring to FIG. 7.

At load 0%, the total fuel is low, fuel P-2, M-1 is supplied to the first premixing chamber 206 and the second premixing chamber 205, the air flow control valve 115 is operated to an open direction in order to effect high efficiency combustion, and air B flowing into the tail tubular liner 114 through the air flow hole 213 is maximized. Until load reaches to a %, air supplied to the combustion chamber 211 is increased proportionally to increase of fuel, so that the air flow control valve 115 is operated to a closed direction to reduce air B to zero. In the range of load a % or more, mixture from the first and second premixing chambers 206 and 205 is burnt at high combustion efficiency without controlling air flow. In the range of load b % or more, fuel M-2 is supplied to the third premixing chamber 207, too.

As a modification of the present embodiment, there is a construction (not shown) in which an air passage is provided on the outer combustion liner for releasing air out of the system, and an air flow control valve is provided for this air passage. Fuel distribution and air flow distribution to a gas turbine output are similar to that shown in FIGS. 6 and 7.

Figure 8:
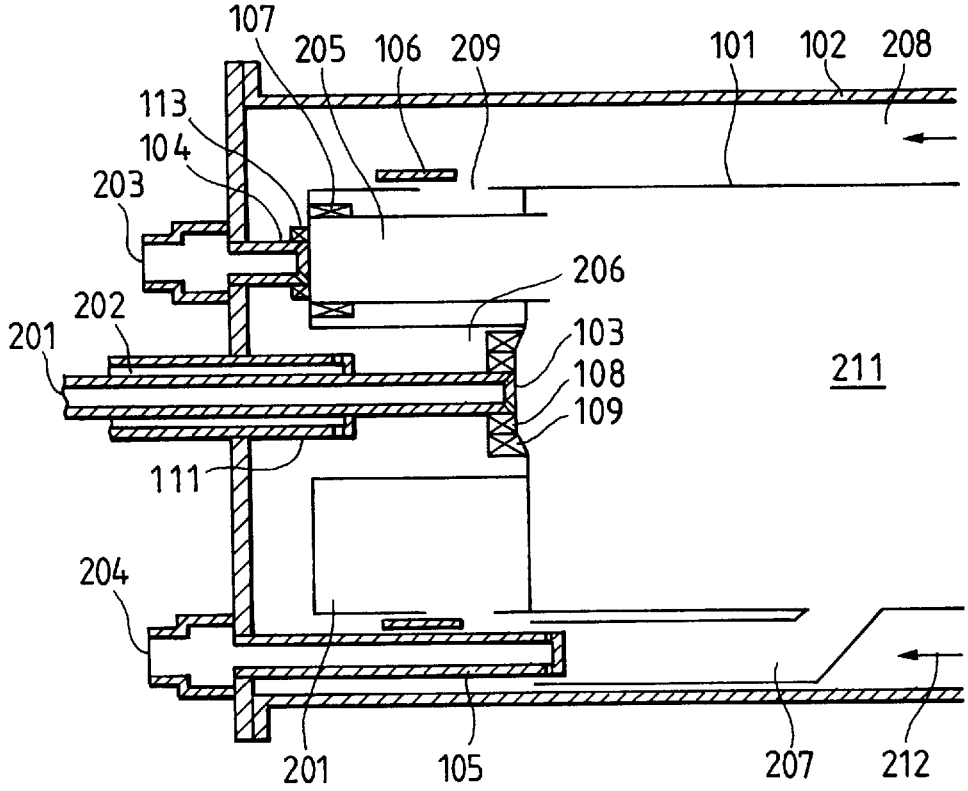
FIG. 8 is a vertical sectional view of the gas turbine combustor provided with a second fuel nozzle.
Figure 9:
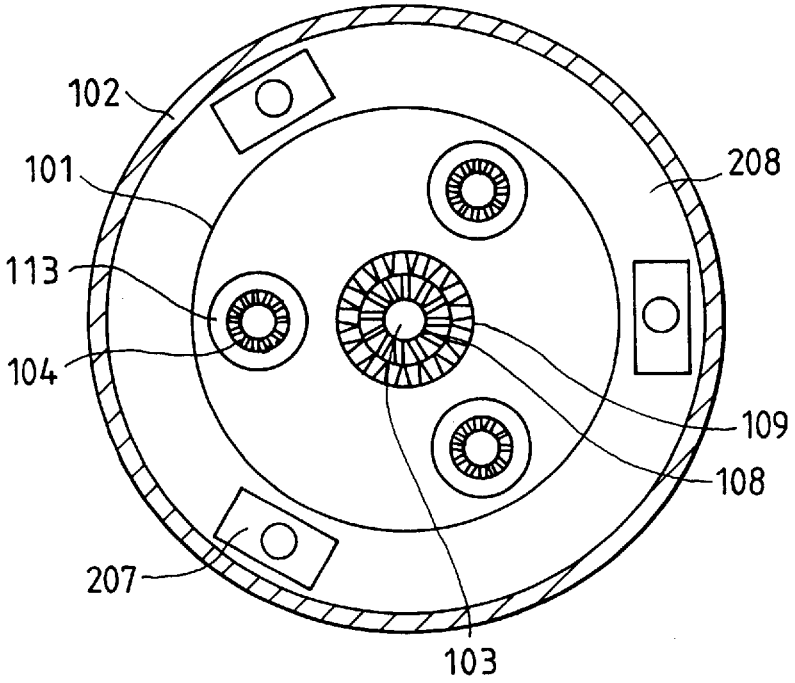
FIG. 9 is a lateral sectional view of the gas turbine combustor provided with a second fuel nozzle.

Another embodiment of a gas turbine combustor provided with the second fuel nozzle is shown in FIGS. 8 and 9.

In FIG. 8, the third premixing chamber 207 is within an annular passage 208 formed by the inner combustion chamber 101 and the outer combustion chamber 102, and the outlet end is provided in the wall of the inner combustion chamber 101. Fuel and air control in this case is similar to that in FIGS. 3 and 4.

Figure 10:
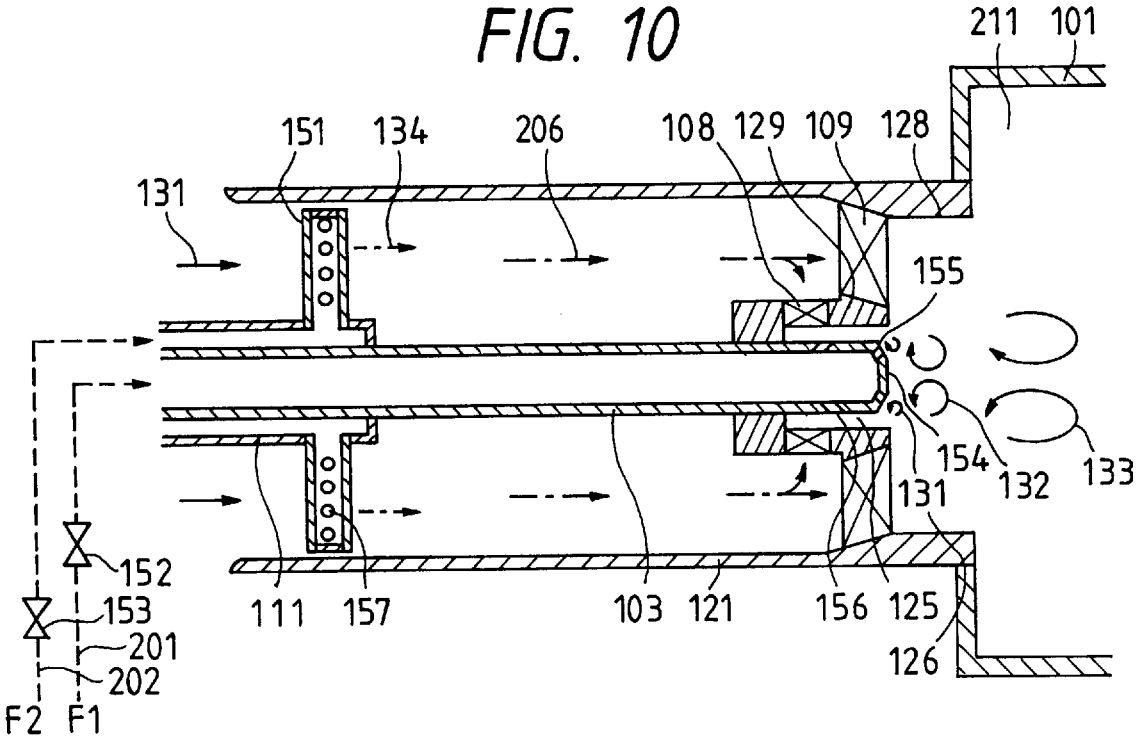
FIG. 10 is a vertical sectional view of a gas turbine combustor of another embodiment of the present invention.

Next, an embodiment of a pilot burner of a gas turbine combustor, corresponding to the first fuel nozzle 103 and the first and second swirlers 108 and 109 is explained, referring to FIG. 10.

FIG. 10 is a vertical sectional view of the pilot burner of a gas turbine combustor. The outside of the pilot burner is formed by a cylindrical inner combustion liner 101 forming a combustion chamber 211, and a second air supply pipe 121 at the upstream side of the inner combustion liner 101. The second air supply pipe 121 has an annular second swirler 109 in the vicinity of the discharge end thereof, and inside of the second swirler 109, a first air supply pipe 129 is provided. The first air supply pipe 129 has, at its inlet end, a first swirler 108 through which fluid flows in the same swirling direction as that from the second swirler 109. At the axis of the first swirler 108, a first fuel nozzle 103 is provided. A second fuel nozzle 111 having a plurality of branch pipes 151 is provided in an annular first premixing chamber 206 formed by the first fuel nozzle 103 and the second air supply pipe 121. Piping 201 for fuel supply having a flow control valve 152 is connected to the first fuel nozzle 103. Piping 202 for fuel supply having a flow control valve 153 is connected to the second fuel nozzle 111.

Structural features of the above-mentioned pilot burner construction of the present embodiment are explained hereunder.

The first fuel nozzle 103 has, at the discharge end 154 thereof, a plurality of first fuel injection ports 155 each directed toward a downstream side and having an angle of smaller than 90° to the axis thereof, and jets radially gaseous fuel. The discharge end 154 of the first fuel nozzle 103 is not necessarily a circular truncated cone shape as shown in FIG. 10, but it may be planar. The first fuel nozzle 103 has a side face provided with a plurality of second fuel injection ports 156 each inclined toward the discharge end side so that fuel flows along the wall face of the first fuel nozzle 103 when the gaseous fuel jet speed is small, and the position is in an axially intermediate portion between the first swirler 108 for supplying air or mixture to the annular passage 125 at the outside and imparting swirling to it, and the discharge end of the first air supply pipe 129. A first swirling air flow swirled by the first swirler 108 and flowing in the annular passage 125 exists at the outer periphery of the gaseous fuel. At the periphery of the first swirler, there are second recirculation flows swirled by the second swirler 109. By the first swirling air flow, small circulation flows 131 are formed in the vicinity of the discharge end 154 of the first fuel nozzle 103, and at the downstream side thereof, relatively large recirculation flows 132 are formed. Further, by the second swirling air flow, further large recirculation flows 133 are formed at the downstream side of the relatively large recirculation flows 132. Further, when a straight pipe portion 128 is provided at the downstream side of the annular second swirler 109 provided on the second air supply pipe 121, the recirculation flows 133 are formed more downstream. When gaseous fuel is injected from the first fuel nozzle 103 to the above-mentioned air flows, in case of large fuel flow, a part of the fuel injected from the first fuel injection port 155 diffuses in air supplied from the first swirler 108 and is stably burnt by the recirculation flows 132, and the remaining part of the fuel diffuses in air supplied from the second swirler 109 to be stably burnt by the recirculation flows 133. On the other hand, fuel injected from the second fuel injection ports 156 impinges on the inner wall of the first air supply pipe 129, premixes partially with air supplied from the first swirler 108, and forms recirculation flows 132 with partial premixed gas. When the fuel flow rate is small, fuel injected from the first fuel injection ports 155 diffuses only in air supplied from the first swirler 108, and is stably burnt by the recirculation flows 132. On the other hand, fuel injected from the second fuel injection ports 156 is jetted into the annular passage 125 of air supplied from the first swirler 108; since the jet speed is small, it does not reach to the inner wall of the first air supply pipe 129, but collects at the central side, so that the fuel concentration of the recirculation flow 132 becomes higher, and the mixture becomes easier to be burnt. In case where the fuel flow is further small, when fuel jetted from the first fuel injection ports 155 diffuses inside the air recirculation flows 132, the fuel concentration becomes too lean. Therefore, although it is burnt within the recirculation flows 131, it penetrates the recirculation flow 131 because the recirculation flow 131 is small even if the fuel injection flow speed from the first fuel injection ports 155 becomes small, so that a small flame is difficult to be formed. On the contrary, since the second fuel injection ports 156 are small in diameter and inclined so that the outlets are directed toward the discharge end, when the fuel jet flow speed becomes small, fuel flows along the wall face of the first fuel nozzle 103 and enters the recirculation flows 131. Therefore, the fuel is mixed with a part of the fuel jetted from the first fuel injection ports 155, whereby stable combustion is possible. Further, the first swirler is desirable to be of radial flow type, however, even a swirler of axial flow type can effect its function.

Next, a case where the diffusion combustion and premixed combustion are effected simultaneously is explained.

Fuel F1 is supplied from the first fuel nozzle 103 to effect diffusion combustion, and fuel F2 is injected from the third fuel injection ports 157 provided on the plurality of branch pipes 151 of the second fuel nozzle 111, and mixed with whole air to be supplied to the first swirler 108 and the second swirler 109 to form a mixture. Air supplied from the first swirler 108 is turned into a mixture of fuel/air, fuel F1 injected from the first fuel injection ports 155 and the second fuel injection ports 156 of the first fuel nozzle 103 becomes easy to be burnt, stable combustion is possible with fuel F1 which is smaller than in the above diffusion combustion only, so that ring-shaped flames are formed with the recirculation flows 131. The flames become ignition sources of the whole, the mixture supplied from the first swirler 108 is burnt by the recirculation flows 132, flames formed by the two recirculation flows become ignition sources for mixture supplied from the second swirler 109 at its outer periphery, stable combustion is effected by the recirculation flows 133, and the whole is burnt. The effect is remarkable when lean mixture which is difficult to be burnt by premixing combustion only is burnt. As a result, it is possible to make the ratio of fuel F1 forming the diffusion flame to the entire fuel be 2% or less, whereby NOx production can be reduced drastically. In particular, in a case where the straight pipe portion 128 is provided downstream of the second swirler 109 and recirculation flows 133 are formed downstream of the recirculation flows 132, the recirculation flows 132, 133 are formed stably, and combustion stability is improved, so that less fuel F1 can be used.

In this case, mixture swirling flow from the first swirler 108 which becomes an ignition source for the mixture swirling flow from the second swirler 109 carries out its function even if a heat amount generated by combustion is small, so that the flow passage area of the first swirler 108 can be made smaller than that of the second swirler 109.

Next, an embodiment of a gas turbine combustor employing the pilot burner in FIG. 10 is explained.

Figure 11:
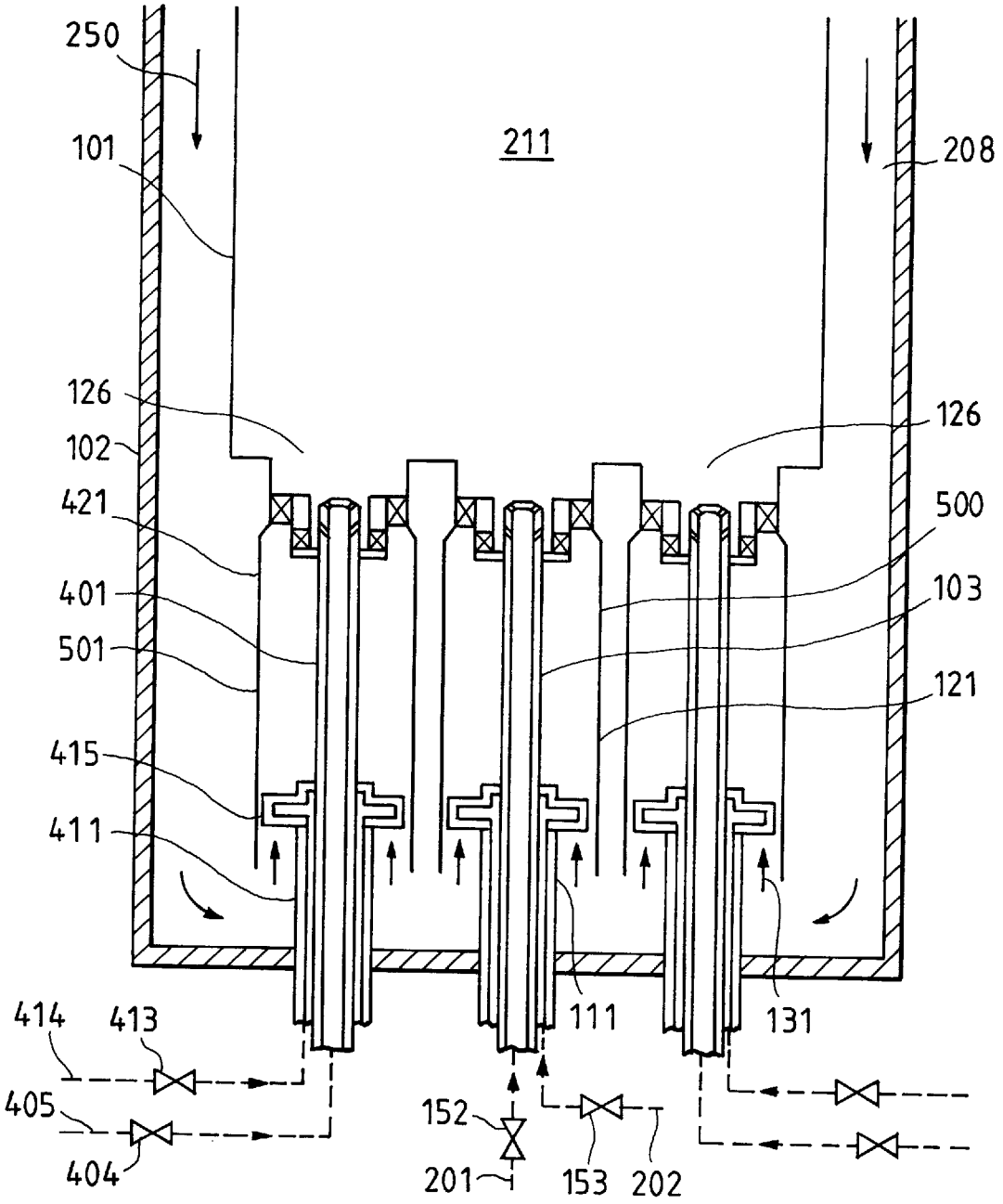
FIG. 11 is a vertical sectional view of an example of a gas turbine combustor employing a pilot burner of FIG. 10.

FIG. 11 is a vertical sectional view of an example of a gas turbine combustor in which the pilot burner in FIG. 10 is used. The pilot burner 500 is arranged on the axis of the combustion chamber 211. A plurality of main burners 501 of the same type as the pilot burner 500 are arranged in parallel at the outer periphery of the pilot burner 500. Outlet ends of those burners are arranged on substantially the same plane, and the combustion chamber 211 is made so as to be one common space formed by the inner combustion liner 101. The inner combustion liner 101, the pilot burner 500, and the plurality of main burners 501 are contained in the outer combustion liner 102 which is a pressure container.

Air supplied from a compressor (not shown) flows in an annular passage 208 formed by the inner and outer combustion liner 101 and 102 in a direction indicated by an arrow 250 and cools the inner combustion liner 101 on its way. A part of the air flows into the second air supply pipe 121 of the pilot burner 500, and almost all the remaining part of the air flows into a second air supply pipe 421 of each of the plurality of main burners 501; the remaining air flows into the combustion chamber 211 through cooling holes (not shown) of an upstream end face of the combustion chamber 211.

Next, a fuel control from starting ignition to 100% load is explained hereunder.

In the construction in FIG. 11, the burners are independent from each other, and it is difficult to cross-fire adjacent burners on the way of operation, so that combustion is effected by all the burners by injecting diffusion combustion fuel from the first fuel nozzle 103 of the pilot burner 500 at the time of starting ignition and injecting simultaneously diffusion combustion fuel from the first fuel nozzle 401 of each of the plurality of main burners, too. Next, the combustor is operated in a range of low load of the gas turbine by injecting mixture from the second fuel nozzle 111 of the pilot burner 500 to effect simultaneously diffusion combustion and premixed combustion. As gas turbine load increases, the number of the main burners 501 of which the second fuel nozzles 411 inject mixture to effect combustion is increased in turn, and at gas turbine load 100%, diffusion combustion and premixed combustion are effected simultaneously by all the main burners 501. At this time, diffusion fuel is about 2% of the entire fuel for the combustor, and the remaining fuel of about 98% is for the premixing combustor by which flame temperature is low, whereby an operation is possible with less NOx production.

Further, in a case where the average gas temperature at the outlet of the combustion chamber 211 is much higher than the auto-ignition temperature, it is possible to effect combustion by injecting the fuel/air mixture into the combustion chamber 211 from a port not having a swirling function, so that it is possible to construct a part of the plurality of main burners 501 without the first fuel nozzle 401 injecting diffusion fuel, a fuel supply system 405 and control valve 404.

Next, another embodiment of the gas turbine combustor employing the pilot burner of FIG. 10 is explained.

Figure 12:
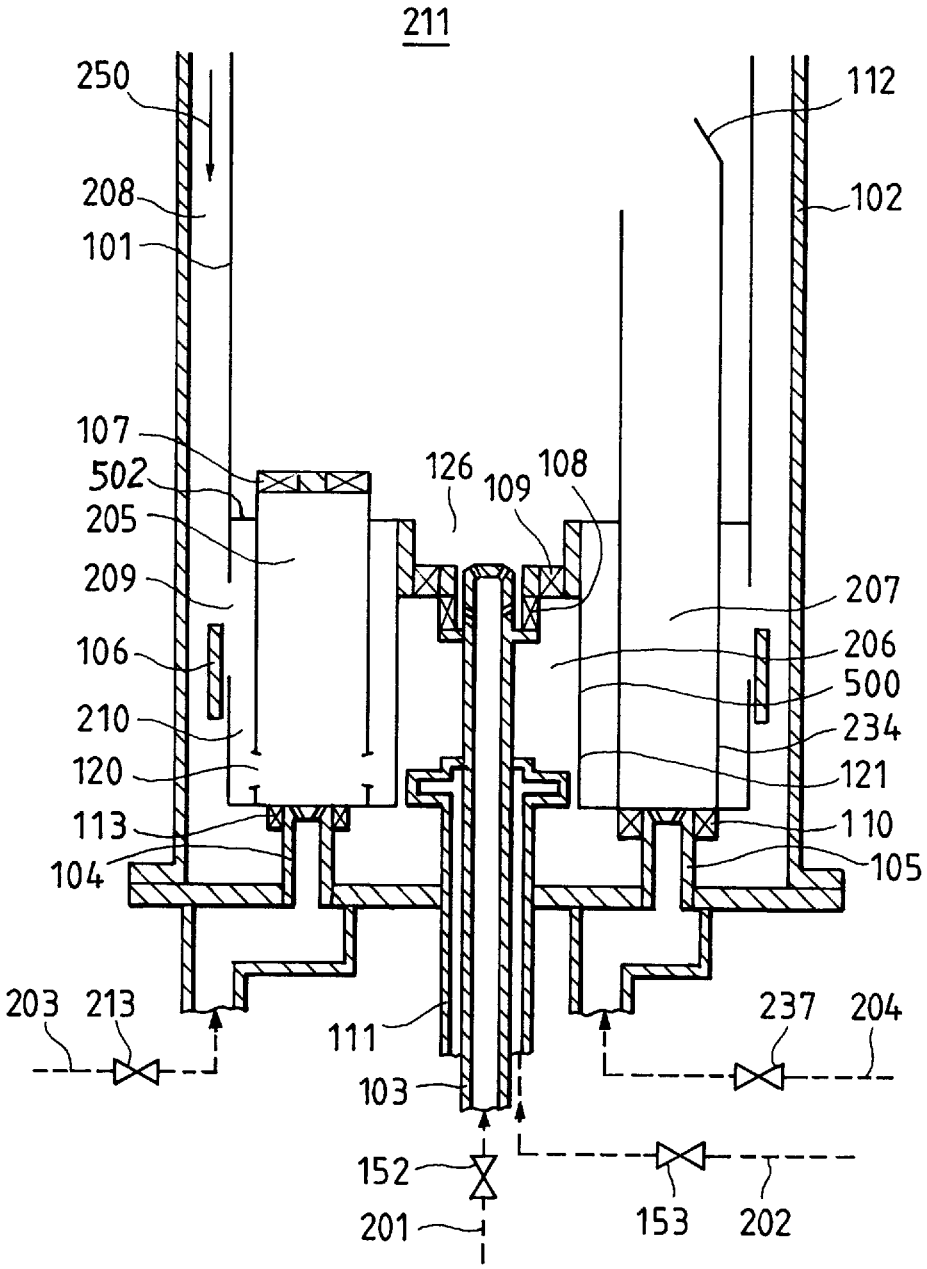
FIG. 12 is a vertical sectional view of a gas turbine combustor of another embodiment of the present invention.
Figure 13:
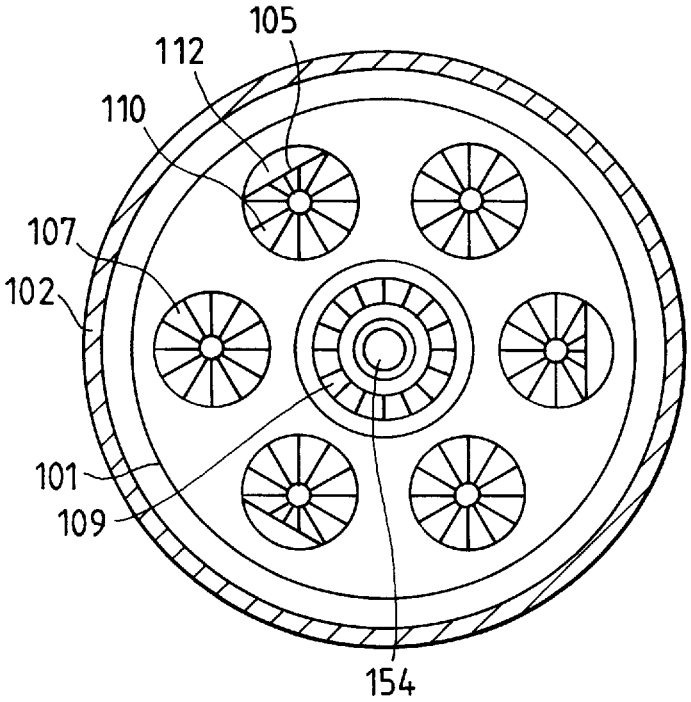
FIG. 13 is a lateral sectional view of another embodiment of the combustor in which an embodiment of the present invention is used.

FIG. 12 is a vertical sectional view of another embodiment of the present invention, FIG. 13 is a horizontal view of the combustor in FIG. 12 viewed from a downstream side. The combustor comprises an inner combustion liner 101 forming a combustion chamber 211; a pilot burner 500 comprising a first fuel nozzle 103 for diffusion fuel supply at the axis of an end of the inner combustion liner 101, first and second swirlers 108 and 109 for air supply at its outer periphery, a second air supply pipe 121 forming an annular first premixing chamber 206, and a second fuel nozzle 111 supplying fuel for premixing to air; a second premixing chamber 205 at the outer periphery of the pilot burner; a third fuel nozzle 104 at the center of an end of the second premixing chamber 205; a third swirler 113 and air holes for air supply at an outer periphery of the second premixing chamber 205; a fourth swirler for imparting swirling to mixture in the vicinity of the outlet end of the second premixing chamber 205; a rectifying chamber 210 for air supplied to the second premixing chamber 205; an air inlet 209 thereof; an air flow control valve 106 controlling an area of the air inlet 209; a third premixing chamber 207 projecting into a middle portion of the combustion chamber 211; a fourth fuel nozzle 105 at the center of an end of the third premixing chamber 207; a fifth swirler 110 for air supply at an outer periphery of the fourth fuel nozzle 105; deflection plate 112 provided at the outlet end of the third premixing chamber 207; an outer combustion liner 102 containing therein the constituent elements of a pressure container; piping 201 supplying fuel to the first fuel nozzle 103; a flow control valve 152 thereof; piping 202 supplying fuel to the second fuel nozzle 111 and a flow control valve 153 thereof; piping 203 supplying fuel to the third fuel nozzle 104 and a flow control valve 213 thereof; and piping 204 supplying fuel to the fourth fuel nozzle 105 and a flow control valve 237 thereof.

Combustion air supplied from a compressor (not shown) flows in an annular passage 208 formed by the inner combustion liner 101 and the outer combustion liner 102 in a direction indicated by an arrow 250, cools the inner combustion liner 101 on the way, branches partially as leakage air into part-inserting parts, and then is supplied into the combustion chamber 211 through the first annular premixing chamber 206, the second premixing chamber 205, and the third premixing chamber 207. Air supplied to the second premixing chamber 205 is controlled of its flow rate by the flow control valve 106 provided at the air inlet 209, and then once retarded in the rectifying chamber 210, flowed into the second premixing chamber 205 through the air hole 120. Further, in the construction of FIG. 12, it is possible to operate without providing the flow control valve 106 for air.

Next, a fuel control method from starting ignition to 100% load is described hereunder.

The starting ignition is effected by supplying fuel from the first fuel nozzles 103 of the pilot burner 500 and supplying energy necessary to ignite by an ignitor not shown. In this case, it is possible to ignite by supplying simultaneously fuel for premixed combustion from the second fuel nozzle 111. Further, in a case where cross-firing to an adjacent combustor at time of starting ignition is necessary, ignition and cross-firing is possible by providing a cross-firing tube communicating with an adjacent inner combustion liner in the vicinity of the outlet end of the second premixing chamber 205 of the inner combustion liner 101, supplying fuel to the pilot burner 500 and also supplying fuel to the third fuel nozzle 104 for supplying fuel to the second premixing chamber 205 in the vicinity of the cross-firing tube. Until load 0% after that, the combustor is operated by continuing combustion by the pilot burner 500 and by part of the second premixing burner 502, and changing, on the way, the combustion to combustion by the pilot burner only.

In the range of low load of the gas turbine, an operation is changed from the combustion by the pilot burner only to simultaneous combustion by supplying fuel to the third fuel nozzle 104 to effect combustion by the second premixing burner 502, too. In this case, the second premixing burner 502 is divided into two groups, and fuel supply piping 203 is provided independently to each group. Fuel control of the two groups is carried out so that first, combustion is effected only in a first group, and then in a second group, whereby an operation is possible in which a large decrease in combustion efficiency and an increase in NOx production are prevented.

Next, in a range of middle load of the gas turbine, combustion is effected by the pilot burner 500 and the second premixing burner 502, when an average temperature at the outlet of the combustion chamber 211 reaches a temperature much higher than an auto-ignition temperature, for example 1200° C. in case of methane, and fuel is supplied from the fourth fuel nozzle 105 to operate under condition of further high load of the gas turbine. The fuel is mixed with air from the fifth swirler 110 in the third premixing chamber 207, and the mixture is jetted into the combustion chamber 211 to be auto-ignited.

In the combustor shown in FIG. 12, a ratio of fuel burnt by the pilot burner 500 to fuel burnt by the whole combustor is 25% or less, and fuel for diffusion combustion supplied from the first fuel nozzle 103 is about 2% of fuel burnt by the pilot burner 500. Therefore, a ratio of diffusion fuel to all fuel is 0.5% or less. Therefore, lean premixed combustion with less NOx production is 99.5% or more of the whole combustion is achieved, so that NOx production can be greatly reduced.

Further, by providing a long length between the stages of the premixing combustors arranged in multi-stages, premixed combustion at an upstream stage is completed, and combustion gas temperature at the outer periphery of the premixing combustor at a downstream stage becomes high, whereby deformation and damage due to temperature elevation at the premixing combustor wall face beyond an allowable temperature of the material is suppressed, so that an air flow passage is provided at least at the outer periphery of the second premixing combustor. An air film is formed, whereby heating the combustor as mentioned above can be suppressed.

Concretely, an air flow passage portion is formed along the outer periphery of the cylinder of the second premixing chamber, at least.

By this construction, heat input from the diffusion flame and premixed combustion flame of the first premixing combustor to the second premixing combustor side face is reduced.

Figure 15:
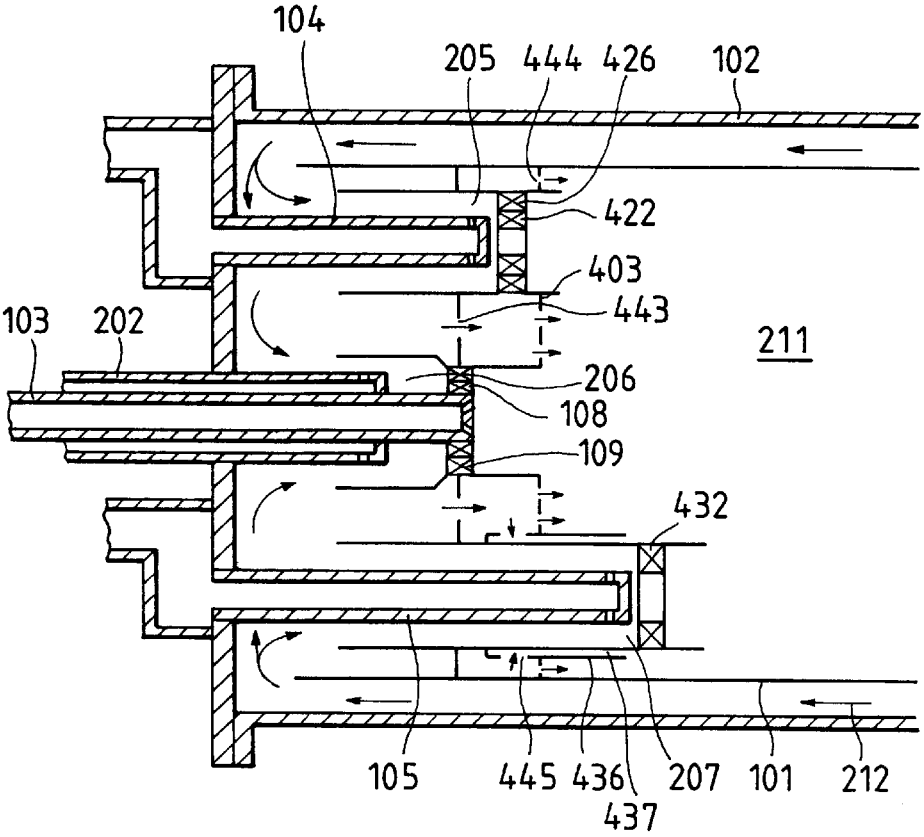
FIG. 15 is a vertical sectional view of a gas turbine combustor of another embodiment of the present invention.

FIG. 15 is a vertical sectional view of an embodiment in which an air cooling portion to the outer periphery of the premixing combustor is provided.

A first premixing combustor is provided at the outer periphery of the above-mentioned mixture injection nozzle, which first premixing combustor comprises a second premixing chamber 205, a third fuel nozzle 104 at the center of an end of the second premixing chamber, a third swirler 422 which is annular and imparts swirling to air supplied to the outer periphery of the third fuel nozzle 104, and a fourth swirler 426 at the outer periphery of the third swirler 422.

A second premixing combustor is provided, which comprises a third premixing chamber 207 formed so that an outlet end thereof projects more downstream than the first premixing combustor, a fifth swirler 432 provided in the vicinity of the outlet end of the third premixing chamber 207 for imparting swirling to air supplied to the third premixing chamber 207, a fourth fuel nozzle 105 for mixing fuel with air from the fifth swirler 432, and guide tubes 436 for flowing air for air cooling into the periphery of the third premixing chamber 207. The guide tubes 436 each have air holes 443 for air cooling at a side face, a part of cooling air from the air hole 443 adjusting the whole flow rate of air from the upstream end of the combustion chamber 211 is supplied to annular passages 437 each formed by the guide tube 436 through air holes 445, and air from the annular passages 437 each having an opening at the middle portion of the third premixing chamber 207 flows along the outer periphery of the third premixing chamber 207.

The remaining air of the cooling air from the air holes 443 flows into the combustion chamber 211 through air holes 444 provided in an inner combustion liner cap 403 forming an upstream part of the combustion chamber 211, to suppress overheating of relevant parts.

Figure 16:
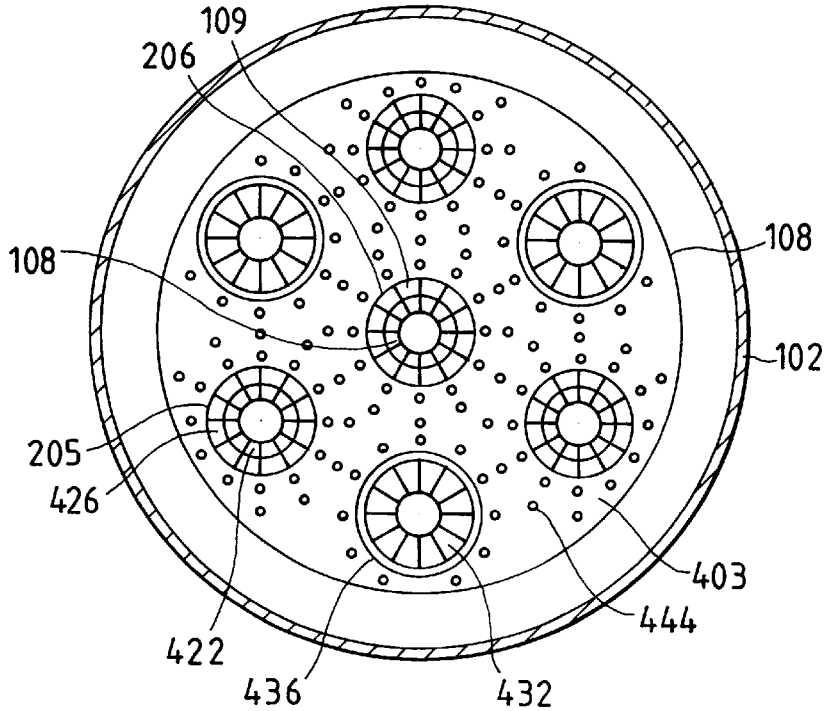
FIG. 16 is a lateral sectional view of a gas turbine combustor of another embodiment of the present invention.

The above-mentioned first premixing combustors and second premixing combustors are arranged alternately in a circumferential direction at the outer periphery side of the diffusion combustor, as shown in FIG. 16.

By this construction, firing can be surely effected from the diffusion combustor to the first premixing combustors, and then to the second premixing combustors, interference between diffusion flame and premixed combustion flame becomes less, the diffusion flame can stably maintain combustion, the premixed combustion flame is less influenced by the diffusion flame and other premixed combustion flames, so that lean combustion can be effected, and NOx suppression can be utilized.

Figure 17:
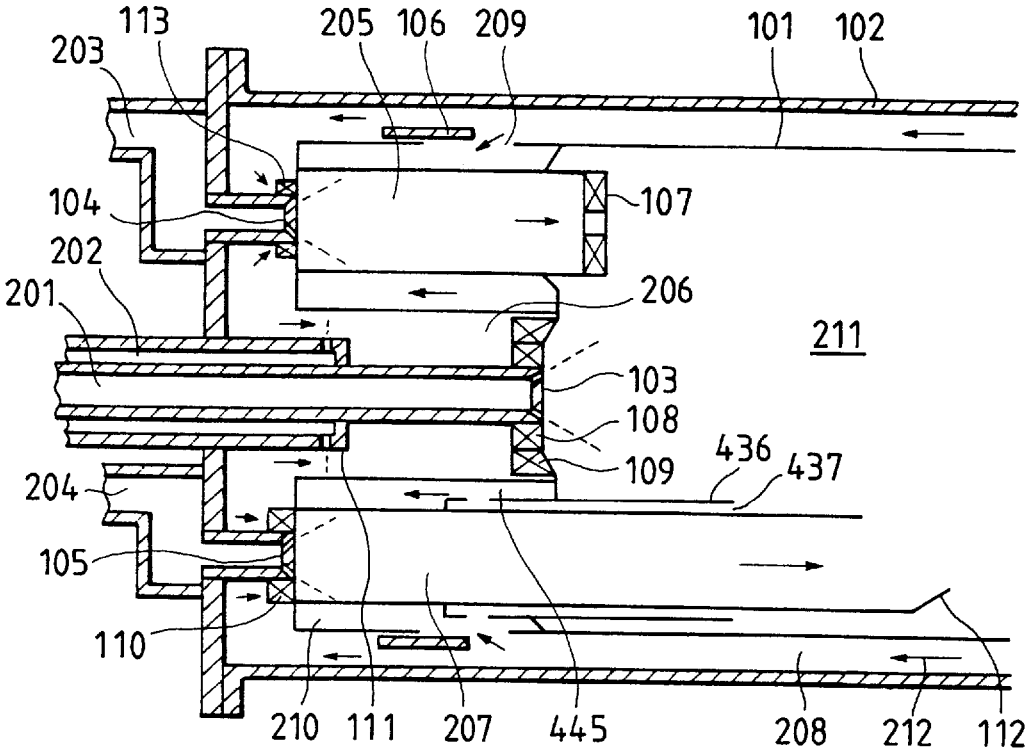
FIG. 17 is a lateral sectional view of a gas turbine combustor of another embodiment of the present invention.

Further, in this case, the second swirler is provided in FIG. 16; however, FIG. 17 shows a combustor in which premixing combustors each are not provided with the second swirler. Even in this case, cooling air is supplied to the annular passage 437 formed by the guide tube 436, flowed from the annular passage 437 of which the opening is disposed at the middle portion of the third premixing chamber 207 and flows along the outer periphery of the third premixing chamber 207, whereby overheat of pertinent portions can be suppressed.

Figure 18:
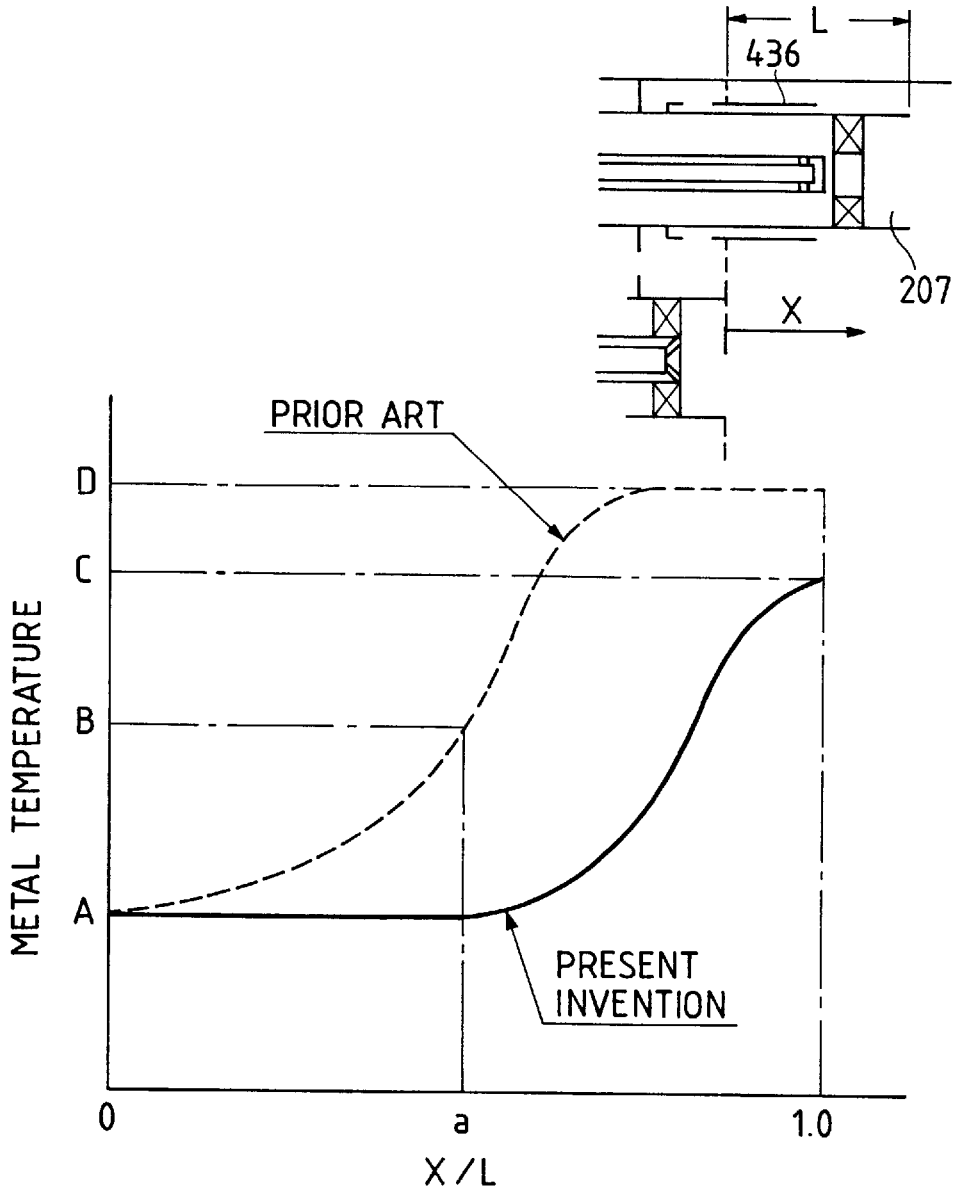
FIG. 18 is a characteristic diagram of the metal temperature of a premixing chamber of a gas turbine combustor of another embodiment of the present invention.

Metal temperature change of the premixing chamber by providing the above-mentioned guide tube 436 to cool is explained, referring to FIG. 18.

An abscissa represents non-dimensional length from an upstream end of the combustion chamber 211, and an ordinate represents metal temperature of the wall face of the third premixing chamber 207. The above-mentioned upstream end is a region corresponding to the above-mentioned inner combustion liner cap, for instance. Since the mixture outlet end of the second premixing combustor projects more downstream than the mixture outlet ends of the diffusion combustor at the axis of the combustion chamber 211 and the first premixing combustor at the outer periphery of the diffusion combustor, the wall face of the third premixing combustor 207 of the second premixing combustor is overheated by high temperature gas generated by combustion at the upstream side. In a conventional construction without guide tubes 436, the metal temperature is low at a root portion but may become more than the allowable temperature C in the vicinity of the outlet of mixture under some combustion conditions of the combustor, as shown by a broken line in FIG. 18. Therefore, by covering, with the guide tube 436, the wall face of the third premixing chamber 131 until a point (a) thereof which is low in metal temperature and flowing cooling air in film form, input heat from combustion gas to the third premixing chamber 207 decreases and the metal temperature can be the allowable temperature C or less of the material in all the region, as shown by a solid line in FIG. 18. By increasing a flow rate of film cooling air, the above-mentioned cooling effect becomes large, but a flow rate of air for forming a lean mixture decreases and NOx production may increase in some cases. Therefore, it is desirable to flow a minimum flow rate of air necessary to keep the metal temperature at the allowable value or less.

Figure 19:
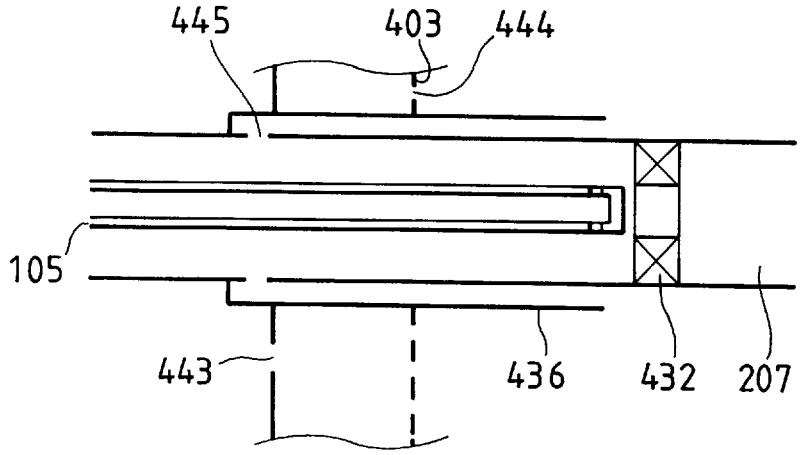
FIG. 19 is a vertical sectional view of another embodiment of a cooling air supplying portion of a gas turbine combustor of another embodiment of the present invention.

Further, another state is explained, referring to FIG. 19. FIG. 19 is an enlarged view of the second premixing part of the combustor, showing a construction in which a guide tube 436 of cooling air is provided at the outer periphery of the third premixing chamber 207 and cooling air is supplied from air holes 445 formed in the third premixing chamber 207 and the side face of the third premixing chamber. Even in this construction, cooling air is supplied through the annular passage 437 formed by the guide tube 436, so that overheat of the outer peripheral portion of the third premixing chamber 207 can be suppressed. In this manner, cooling air can be supplied from the side face of the premixing chamber more upstream than the mixture fuel nozzle.

Figure 14:
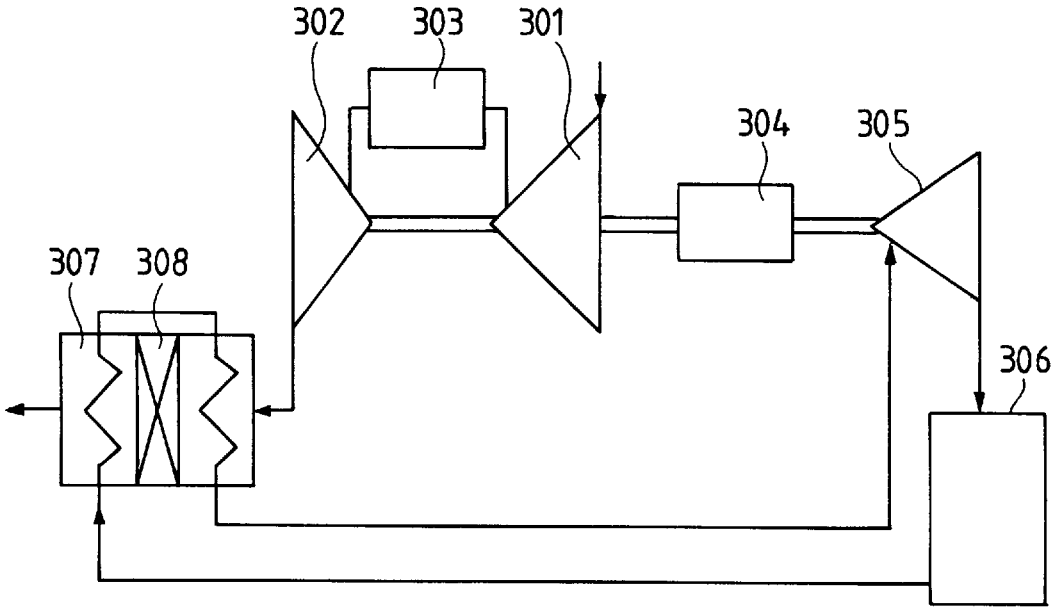
FIG. 14 is a block diagram of a combined power plant system in which a gas turbine combustor relating to the present invention is applied.

A gas turbine (a steam turbine combined power plant system in which the present invention is applied) is shown in FIG. 14. Air from a compressor 303 is introduced into a combustor 301, and fuel is supplied there to produce high temperature combustion gas of low NOx concentration. The gas expands in a gas turbine 302 thereby to work, and the work is taken out as output of a generator 304. The combustion exhaust gas having worked is introduced into a waste heat recovery boiler 307. Usually, the NOx concentration is reduced by a denitration (de-NOx) apparatus provided in the boiler, but the system in which the present invention is applied is unnecessary to provide such a de-NOx apparatus. In the waste heat recovery boiler 307, steam is generated, the steam is introduced into a steam turbine 305 to work, and the work is taken out as output of the generator 304.

What is claimed is:

1. A gas turbine combustor comprising:

a diffusion combustor arranged at an axis portion of a combustion chamber for injecting fuel and effecting diffusion combustion;

a plurality of first premixing combustors arranged at an outer periphery of said diffusion combustor for injecting a mixture of air and fuel and effecting premixed combustion, each of said plurality of first premixing combustors being formed so that a mixture outlet end thereof projects more downstream than a fuel outlet end of said diffusion combustor;

a plurality of second premixing combustors each formed so that a mixture outlet thereof projects more downstream than the mixture outlet end of said each first premixing combustor;

wherein said first premixing combustors and said second premixing combustors are arranged alternately at the outer periphery of said diffusion combustor; and wherein a swirler is provided on said each first premixing combustor in the vicinity of the mixture outlet end thereof for imparting swirling motion to the mixture.

2. A gas turbine combustor according to claim 1, wherein swirlers for imparting swirling motion to mixture are provided in the vicinity of the mixture outlet of each of said plurality of first premixing combustors and said plurality of second premixing combustors, and a swirling momentum by the swirler of said first premixing combustor is larger than that by the swirler of said second premixing combustor.

3. A gas turbine combustor according to claim 1, wherein a mixture outlet end of each of said second premixing combustors is formed so that a flow direction of mixture from said premixing combustor is directed toward the axis of an inner combustion liner forming said combustion chamber.

4. A gas turbine combustor according to claim 1, wherein each of said premixing combustors has a flow passage for air supply formed at an outer periphery thereof.

5. A diffusion combustor comprising:

a first fuel nozzle, being tubular, having an inlet end and an outlet end, and arranged at an axial portion of the combustor;

a first air supply pipe, disposed coaxially with and at an outer periphery of said first fuel nozzle, having a first swirler at an inlet end thereof and a discharge end thereof positioned in the vicinity of the outlet end of said first fuel nozzle;

a second tubular air supply pipe disposed coaxially with said first fuel nozzle and at an outer periphery of said first air supply pipe, and having an annular second swirler in the vicinity of the discharge end of said first air supply pipe, said second swirler having a same swirling direction as that of said first swirler;

a combustion chamber at the downstream side of the outlet end of said second air flow pipe;

a plurality of first fuel injection ports at the discharge end of said first fuel nozzle; and a plurality of second fuel injection ports in the side face of the said first fuel nozzle between said first swirler of said first air supply pipe and the discharge end thereof.

6. A diffusion-premixing combustor comprising:

a diffusion combustor as defined in claim 5;

wherein in said diffusion combustor, an inlet end of said first supply pipe is branched from said second supply pipe, a second fuel nozzle is provided for injecting fuel to be mixed with air supplied to said first and second air supply pipes to an upstream side of the branch portion, and fuel supplied to said first and second fuel nozzles is independently controlled.

7. A gas turbine combustor, wherein a plurality of said diffusion-premixing combustors as defined in claim 6, are arranged in parallel;

a combustion chamber is formed downstream of the discharge end of the second air supply pipe, and the number of said diffusion-premixing combustors to be operated according to gas turbine load is increased or decreased.

8. A gas turbine combustor comprising:

a diffusion combustor, arranged at an axis portion of a combustion chamber, for injecting fuel and effecting diffusion combustion;

a plurality of air supply means provided for said diffusion combustor in the vicinity of a fuel outlet of said diffusion combustor for supplying air in the vicinity of the fuel outlet of said diffusion combustor; and a premixing combustor arranged at an outer periphery of said diffusion combustor for injecting fuel/air mixture and effecting premixed combustion;

wherein fuel supply means is provided for supplying fuel to said air supply means and pre-mixture of air and fuel is supplied for combustion of fuel from said fuel outlet of said diffusion combustor from each of said air supply means.

9. A gas turbine combustor provided with a diffusion fuel nozzle arranged at an axis portion of a combustion chamber for injecting fuel and effecting diffusion combustion, and a premixing combustor arranged at an outer periphery of said diffusion combustor for injecting a mixture of air and fuel and effecting premixed combustion, wherein an annular mixture injection nozzle for injecting a mixture of fuel and air is provided around said diffusion fuel nozzle and inside said premixing chamber for effecting diffusion combustion of fuel injected from said diffusion fuel nozzle, a first swirler and a second swirler positioned at an outer periphery of the first swirler for imparting swirling motion to the mixture are provided at a mixture outlet end of said mixture injection nozzle, said first and second swirler are formed so that a swirling direction of mixture from said first swirler is the same as that from said second swirler, and a flow rate of mixture from said second swirler is larger than that from said first swirler.

10. A gas turbine combustor comprising:

a diffusion combustor provided at an axis portion of the gas turbine combustor for injecting fuel and effecting diffusion combustion in a combustion chamber;

a plurality of first premixing combustors arranged at the outer periphery of said diffusion combustor for injecting a mixture of air and fuel and effecting premixed combustion;

a plurality of second premixing combustors formed so that mixture outlet ends thereof project more downstream than those of said first premixing combustors;

a mixture injection nozzle for supplying mixture of air and fuel into said combustion chamber in the vicinity of a fuel outlet end of said diffusion combustor provided between said diffusion combustor and said first and second premixing combustors;

wherein said first and second premixing combustors are alternately arranged in a periphery direction at the outer periphery side of said diffusion combustor;

wherein, swirlers are provided in the vicinity of the mixture outlet ends of said first premixing combustors for imparting swirling motion to the mixture;

wherein fuel is injected from said mixture injection nozzles, said first premixing combustors, and said second premixing combustors in the mentioned order so as to increase a flow rate of the mixture as a gas turbine load increases.

11. A gas turbine combustor comprising:

a diffusion combustor, arranged at an axis portion of a combustion chamber, for injecting fuel and effecting diffusion combustion;

a premixing combustor arranged at an outer periphery of said diffusion combustor for injecting fuel/air mixture and effecting premixed combustion;

wherein said diffusion combustor comprises:

a cylindrical liner extending along the axis of said diffusion combustor;

a tubular diffusion fuel nozzle, disposed at the axis of said cylindrical liner and having a diffusion fuel outlet at a downstream side thereof within said cylindrical liner;

an air chamber, defined by said tubular diffusion fuel nozzle and said cylindrical liner, having an air outlet at a downstream side thereof and in the vicinity of said diffusion fuel outlet for supplying air in the vicinity of the diffusion fuel outlet of said diffusion combustor; and a fuel inlet provided at an upstream side of said air chamber for supplying fuel into said air chamber to premix the fuel with air in said air chamber, whereby fuel air pre-mixture is supplied from said air outlet of said air chamber for combustion of diffusion fuel from said tubular diffusion fuel nozzle.

12. A gas turbine combustor according to claim 11, wherein said diffusion fuel outlet has a plurality of first fuel injection ports provided at a downstream end of said tubular diffusion fuel nozzle and a plurality of second fuel injection ports provided in a side wall of said tubular fuel nozzle at a little more upstream side than said first fuel injection ports, and said air outlet of said air chamber has a first swirler facing said plurality of second fuel injection ports and a second swirler directed to a diffusion combustion chamber downstream of said tubular diffusion fuel nozzle.

* * * * *